US010774529B2

(12) United States Patent
Evans

(10) Patent No.: US 10,774,529 B2
(45) Date of Patent: Sep. 15, 2020

(54) CEILING TILE WITH INTEGRATED LIGHTING AND CEILING SYSTEM

(71) Applicant: CertainTeed Ceilings Corporation, Malvern, PA (US)

(72) Inventor: Phillip Evans, Littleton, MA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

(21) Appl. No.: 16/231,573

(22) Filed: Dec. 23, 2018

(65) Prior Publication Data

US 2019/0203465 A1 Jul. 4, 2019

Related U.S. Application Data

(60) Provisional application No. 62/611,587, filed on Dec. 29, 2017.

(51) Int. Cl.

| | |
|---|---|
| ***F21S 8/00*** | (2006.01) |
| ***E04B 9/00*** | (2006.01) |
| ***F21S 8/02*** | (2006.01) |
| ***F21V 7/00*** | (2006.01) |
| ***F21V 21/04*** | (2006.01) |
| *E04B 9/06* | (2006.01) |
| *F21Y 103/10* | (2016.01) |
| *E04B 9/04* | (2006.01) |
| *F21Y 115/10* | (2016.01) |

(Continued)

(52) U.S. Cl.

CPC ..... *E04B 9/006* (2013.01); *F21S 8/026* (2013.01); *F21V 7/0008* (2013.01); *F21V 21/041* (2013.01); *E04B 9/0435* (2013.01); *E04B 9/068* (2013.01); *E04B 9/242* (2013.01); *F21Y 2103/10* (2016.08); *F21Y 2103/33* (2016.08); *F21Y 2115/10* (2016.08)

(58) Field of Classification Search

None

See application file for complete search history.

(56) References Cited

U.S. PATENT DOCUMENTS

| | | | |
|---|---|---|---|
| 4,577,264 | A | 3/1986 | Plumly |
| 5,588,737 | A | 12/1996 | Kusmer |

(Continued)

FOREIGN PATENT DOCUMENTS

| | | | |
|---|---|---|---|
| CN | 202208987 | U | 5/2012 |
| EP | 1933086 | A1 | 12/2007 |

(Continued)

OTHER PUBLICATIONS

International Search Report and Written Opinion issued in co-pending International Patent Application No. PCT/US2018/067433, ISA/KR Korean Patent Office, dated Apr. 24, 2019, 15 pages.

(Continued)

*Primary Examiner* — Vip Patel

(74) *Attorney, Agent, or Firm* — McDonnell Boehnen Hulbert & Berghoff LLP

(57) ABSTRACT

The present disclosure relates generally to a ceiling tile, for example, suitable for use in a ceiling grid. The present disclosure relates more particularly to a ceiling tile including a light housing extending across a first portion of a width of the ceiling tile, and a panel extending across a remaining portion of the width of the ceiling tile.

20 Claims, 12 Drawing Sheets

(51) Int. Cl.
*E04B 9/24* (2006.01)
*F21Y 103/33* (2016.01)

(56) References Cited

U.S. PATENT DOCUMENTS

| | | | | |
|---|---|---|---|---|
| 5,782,551 | A | 7/1998 | Capaul | |
| 5,988,836 | A * | 11/1999 | Swarens | F21S 8/02 362/217.06 |
| 10,006,619 | B1 * | 6/2018 | Niemiec | F21V 3/00 |
| 2006/0262521 | A1 | 11/2006 | Piepgras | |
| 2008/0266843 | A1 | 10/2008 | Villard | |
| 2011/0203210 | A1 | 8/2011 | Cousin | |
| 2013/0083514 | A1 | 4/2013 | Wong | |
| 2016/0116118 | A1 | 4/2016 | Bernard et al. | |
| 2016/0178145 | A1 | 6/2016 | Oleske | |
| 2016/0258615 | A1 | 9/2016 | Booij | |
| 2018/0363865 | A1 * | 12/2018 | Nicolai | F21V 29/89 |

FOREIGN PATENT DOCUMENTS

| | | | |
|---|---|---|---|
| EP | 2650599 | A1 | 4/2012 |
| JP | H08-296294 | A | 11/1996 |
| KR | 101669955 | B1 | 10/2015 |
| WO | 2013153534 | A1 | 10/2013 |
| WO | 2013190447 | A2 | 12/2013 |
| WO | 2014187788 | A1 | 11/2014 |
| WO | 2016110380 | A1 | 7/2016 |

OTHER PUBLICATIONS

Kqrpnb, "Moveable Drop Ceiling LED Light Panels," available at http://www.instructables.com/id/Moveable-Drop-Ceiling-LED-Light-Panels/, downloaded Aug. 30, 2017.

Techzone(TM) Ceiling Systems Selection Guide, Armstrong Ceiling Solutions, downloaded Aug. 2017.

* cited by examiner

CEILING TILE WITH INTEGRATED LIGHTING AND CEILING SYSTEM

CROSS-REFERENCE TO RELATED APPLICATIONS

This application claims the benefit of priority of U.S. Provisional Patent Application No. 62/611,587, filed Dec. 29, 2017, which is hereby incorporated herein by reference in its entirety.

BACKGROUND OF THE DISCLOSURE

1. Field of the Disclosure

The present disclosure relates generally to ceiling tiles, for example, suitable for placement in a ceiling grid. The present disclosure relates more particularly to a ceiling tile with an integrated light.

2. Technical Background

Ceiling tiles provide a practical and cost effective structure for constructing ceilings. The ceiling can be maintained easily by replacing old or damaged ceiling tiles, and any maintenance that is needed within the ceiling can be easily completed by temporarily removing one or more tiles. While the replacement of an entire ceiling tile with a similarly shaped lighting fixture is known, consumer preference mandates the availability of a variety of different lighting structures in tiled ceilings.

One lighting structure that is attractive and well-liked by consumers is linear lighting. In particular, linear lighting that spans a length that is longer than one ceiling tile is popular. To provide such lighting, contractors who are building a ceiling grid that will hold the ceiling tiles will incorporate a linear lighting structure into the grid itself. In other words, beams of the ceiling grid are constructed to surround the linear lighting structure, and the adjacent ceiling tiles are either cut down to size or shifted over to accommodate the linear light. The process of building additional grid to accommodate the linear light is time consuming and costly. Moreover, once the linear lighting is built into the ceiling grid, adjusting the lighting to accommodate new design preferences requires rebuilding the ceiling grid, which is nontrivial. The present inventors have recognized that a more convenient and flexible way to provide lighting in ceiling systems, including linear lighting, would be advantageous and attractive to builders.

SUMMARY OF THE DISCLOSURE

In one aspect, the present disclosure provides a ceiling tile comprising:

- a light housing extending across a first portion of a width of the ceiling tile; and
- a panel extending across a remaining portion of the width of the ceiling tile.

In another aspect, the disclosure provides a ceiling system comprising:

- a ceiling grid including a plurality of beams defining a plane of the ceiling;
- a plurality of first ceiling tiles supported by the ceiling grid; and
- one or more second ceiling tiles including:
  - a light housing extending across a first portion of a width of the ceiling tile, and
  - a panel extending across a remaining portion of the width of the second ceiling tile.

In another aspect, the disclosure provides a method of installing ceiling tiles in a ceiling, the method comprising:

- providing a ceiling grid including a plurality of beams defining a plane and arranged to provide a plurality of openings for ceiling tiles;
- placing a plurality of first ceiling tiles in a first portion of the openings; and
- placing one or more second ceiling tiles in at least one other opening in the ceiling grid so as to form a ceiling system comprising:
  - the ceiling grid;
  - the plurality of first ceiling tiles supported by the ceiling grid; and
  - the one or more second ceiling tiles, each of the second ceiling tiles including:
    - a light housing extending across a first portion of a width of the ceiling tile, and
    - a panel extending across a remaining portion of the width of the ceiling tile.

In another aspect, the disclosure provides a method of installing ceiling tiles in a ceiling, the method comprising:

- providing a ceiling grid including a plurality of beams defining a plane and arranged to provide a plurality of openings for ceiling tiles;
- placing a first ceiling tile in a first opening in the ceiling grid; and
- placing a second ceiling tile in a second opening in the ceiling grid, the second ceiling tile including:
  - a light housing extending across a first portion of a width of the ceiling tile, and
  - a panel extending across a remaining portion of the width of the ceiling tile.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

Figure 1A:
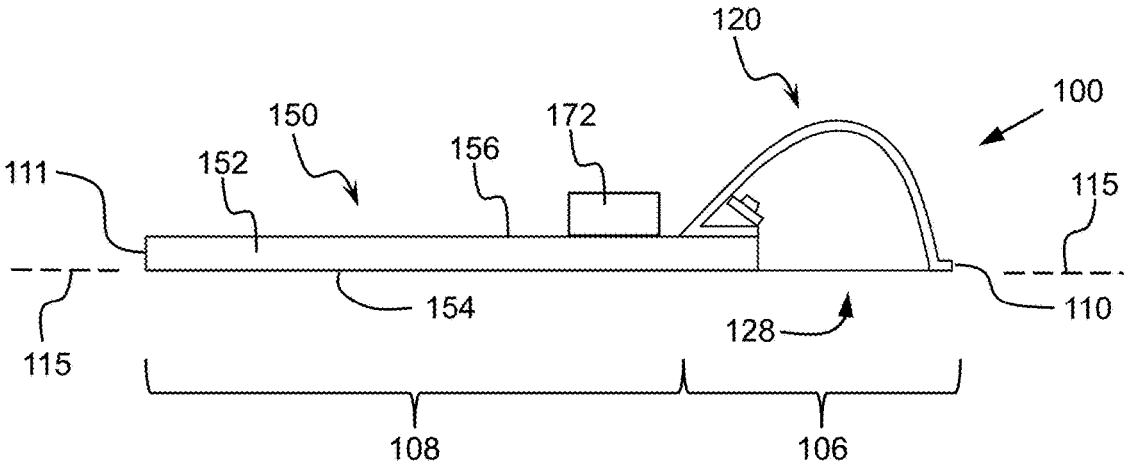
FIG. 1A is a schematic cross sectional side view of a ceiling tile according to an embodiment of the disclosure.
Figure 1B:
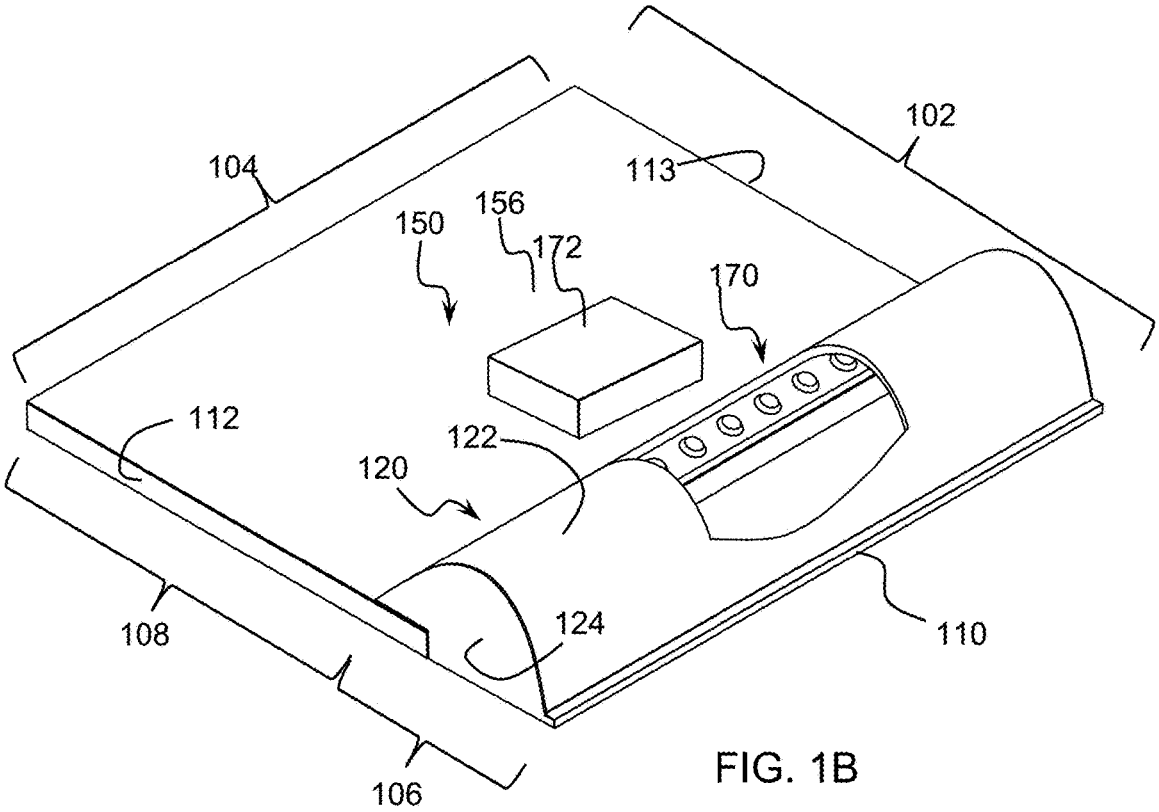
FIG. 1B is a schematic perspective top view of the ceiling tile of FIG. 1A.
Figure 1C:
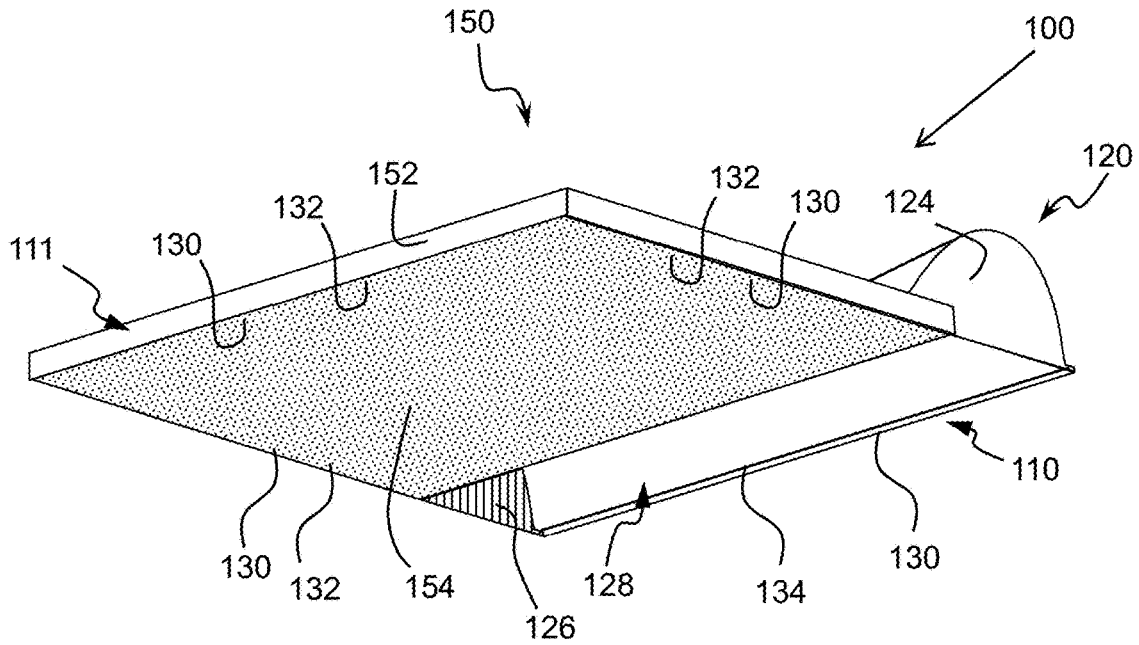
FIG. 1C is a schematic perspective bottom view of the ceiling tile of FIG. 1A.

As described above, the present inventors have noted that conventional lighting in a ceiling grid is costly and time consuming to construct. Further, modifying the lighting once constructed is also costly and time consuming. The present inventors have developed a ceiling tile that provides lighting that is more efficient and easier to construct and modify.

Accordingly, one aspect of the disclosure is a ceiling tile including a light housing extending across a first portion of a width of the ceiling tile, and a panel extending across a remaining portion of the width of the ceiling tile. Such a ceiling tile is shown in FIGS. 1A to 1D. Ceiling tile 100 includes a light housing 120 and a panel 150. As a whole, ceiling tile 100 has a width 102 and a breadth 104 (shown in FIG. 1B). The light housing 120 extends across a first portion 106 of the width 102 of ceiling tile 100. Light housing 120 also extends across the entire breadth 104 of ceiling tile 100. In use, light housing 120 provides a linear presentation of light into a room in which ceiling tile 100 is installed. For example, the light housing 120 reflects light from a light source 170 in the form of a strip of light emitting diodes (LEDs) to an area below the ceiling tile. Panel 150 has some overlap with light housing 120 and extends into the first portion 106 of the width 102 of the tile, but also extends across the remaining portion 108 of the width 102 of ceiling tile 100. Similar to light housing 120, panel 150 also extends across the entire breadth 104 of ceiling tile 100.

The light in ceiling tile 100 is integrated into the tile such that construction of areas of the ceiling that include the lighting can be completed in much the same way that the areas of the ceiling that include conventional ceiling tiles are constructed. Once the ceiling grid is assembled, ceiling tile 100 with the integrated lighting can be placed into an opening in the grid to form a section of the ceiling with integrated lighting. Thus, ceiling tile 100 allows for the construction of lighting without any specialized placement of the ceiling grid beams or any added beams.

The integral construction of the light into ceiling tile 100 is accomplished by the attachment of the light housing 120 to the panel 150 of the tile. As the person of ordinary skill in the art will appreciate, the connection between the light housing and the panel can be accomplished in a variety of different ways. For example, the light housing may be attached to the panel using adhesive or fasteners. Other common methods are also possible.

In certain embodiments as otherwise described herein, the light housing is a linear light housing. The linear light housing extends across at least a portion of the ceiling tile and presents a linear representation of light into the space being illuminated. For example, the light housing in ceiling tile 100 is a linear light housing 120 and extends across the entire breadth of the ceiling tile 100. Accordingly, linear light housing 120 presents a line of light that spans the entire breadth of the tile 100.

In certain embodiments as otherwise described herein, the light housing extends across the first portion of the width of the ceiling tile from a first edge of the ceiling tile. For example, light housing 120 extends across the first portion 106 of ceiling tile 100 from edge 110. Accordingly, the side of ceiling tile closest to edge 110 is entirely formed by lighting housing 100. In other embodiments the portion of the width of the ceiling tile that the lighting housing extends across is spaced from the corresponding edges.

Figure 2A:
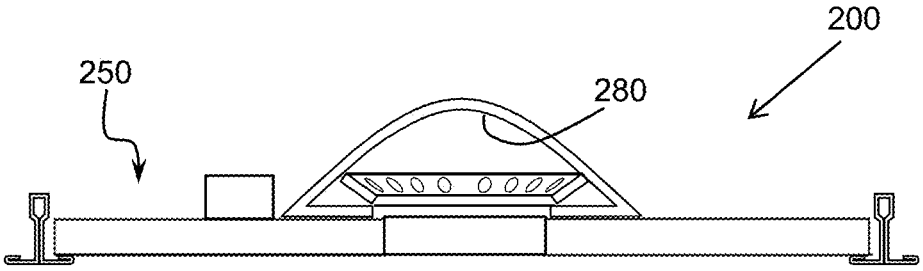
FIG. 2A is a schematic cross sectional view of a ceiling tile according to another embodiment of the disclosure in cooperation with elements of a ceiling grid.
Figure 2B:
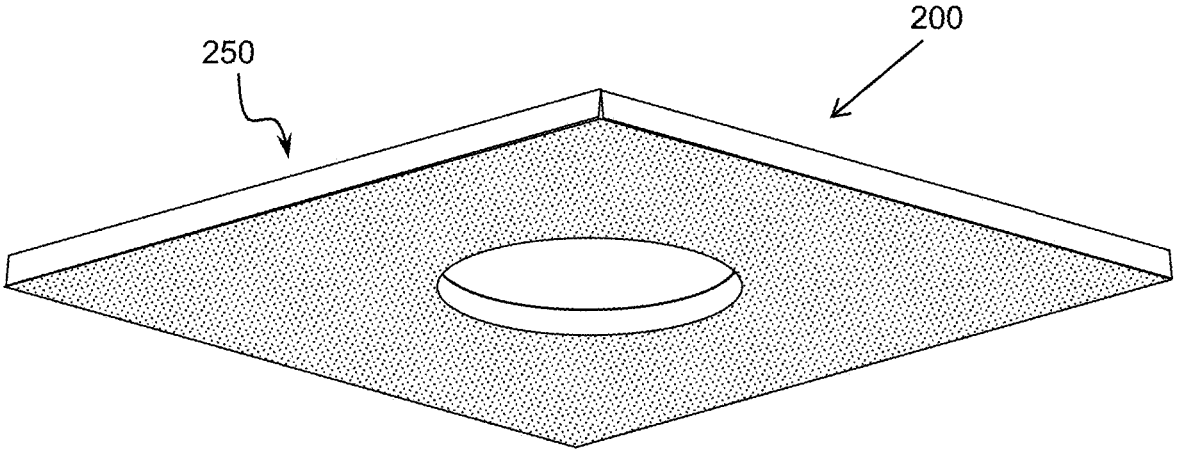
FIG. 2B is a schematic perspective bottom view of the ceiling tile of FIG. 2A.

In certain embodiments as otherwise described herein, the light housing is non-linear. For example, ceiling tile 200, shown in FIGS. 2A and 2B, includes a circular light housing 220. The circular light housing 220 extends across a first portion of the width of the ceiling tile that is located at the center of the ceiling tile. Accordingly, the panel 250, extends across the remaining portion of the width of the ceiling tile on either side of the light housing 220. A light source in the form of a ring of LEDs shines light up onto a dome-shaped reflector 280 that shines light down into the space below ceiling tile 200. The ring of LEDs is disposed above panel 250, and is therefore hidden when viewed from below.

Figure 3A:
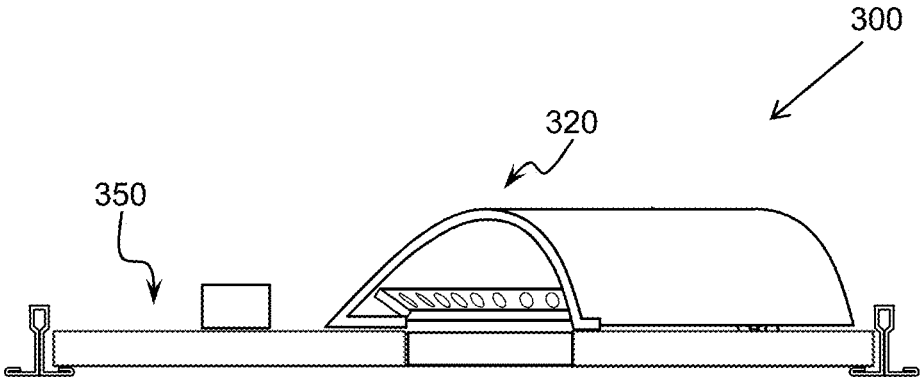
FIG. 3A is a schematic cross sectional view of a ceiling tile according to another embodiment of the disclosure in cooperation with elements of a ceiling grid.
Figure 3B:
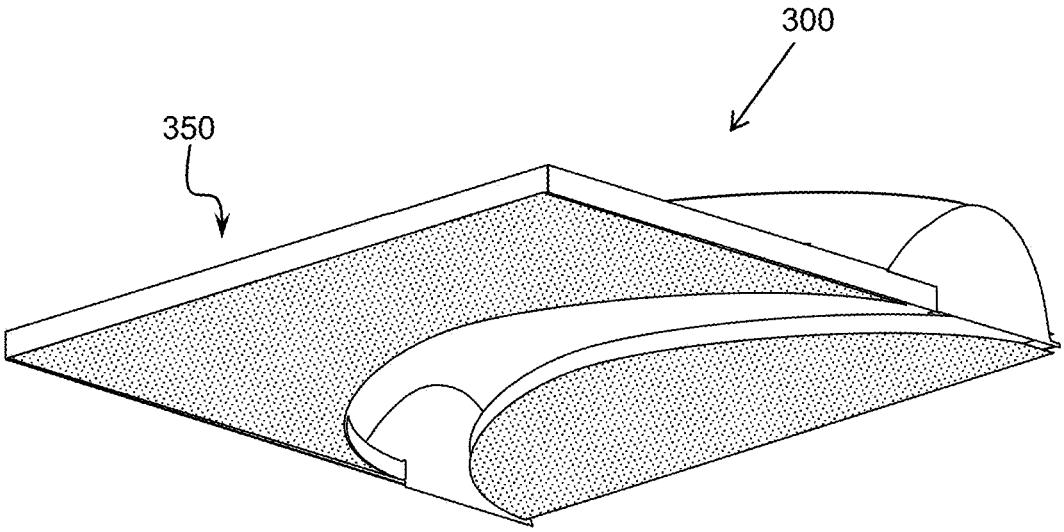
FIG. 3B is a schematic perspective bottom view of the ceiling tile of FIG. 3A.
Figure 4:
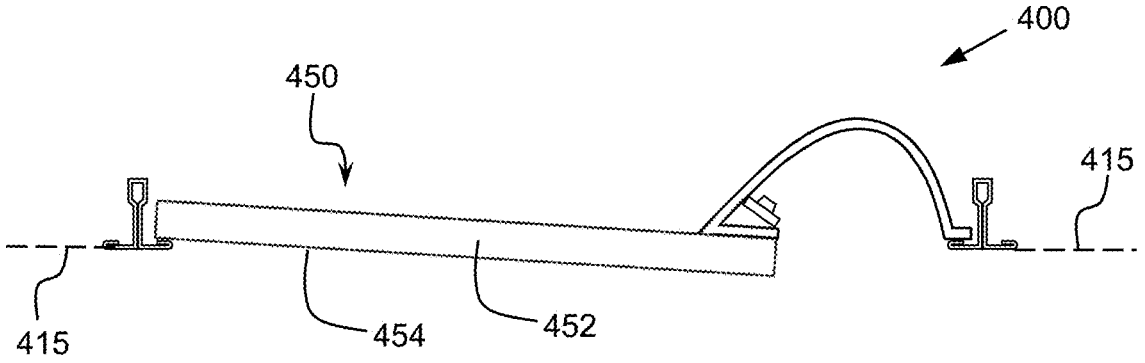
FIG. 4 is a schematic cross sectional view of a ceiling tile according to yet another embodiment of the disclosure in cooperation with elements of a ceiling grid

Ceiling tile 300, shown in FIGS. 3A and 3B also depicts a non-linear lighting housing. Specifically, lighting housing 320 is in the shape of an arc, and panel sections 350 are disposed on both sides of lighting housing 320. The light source in ceiling tile 300 is provided by a strip of LEDs that is arranged in a curve within light housing 320 following the curve of the arc. The strip of LEDs is disposed above one of the panel sections 350 and is therefore obscured from view when looking up at the tile 300.

In certain embodiments as otherwise described herein, the panel includes a body having a planar surface. In certain embodiments, the planar surface is parallel to the plane of the ceiling. For example, ceiling tile 100 includes a panel having a body 152 that has a planar surface 154. The planar surface 154 is arranged to be parallel to a plane of the ceiling 115 when ceiling tile 100 is installed in the ceiling. In other embodiments, the panel includes a planar surface that is at an angle to the plane of the ceiling. For example, in some embodiments the planar surface of the panel is at an angle of no more than 30 degrees from the plane of the ceiling, e.g., no more than 20 degrees from the plane of the ceiling, e.g., no more than 10 degrees from the plane of the ceiling, e.g., no more than 5 degrees from the plane of the ceiling, such as 3 or 4 degrees. For example ceiling tile 400 includes a panel 450 with a body 452 that includes planar surface 454.

The planar surface 454 is disposed at a slight angle with respect to the plane of the ceiling 415.

Figure 1D:
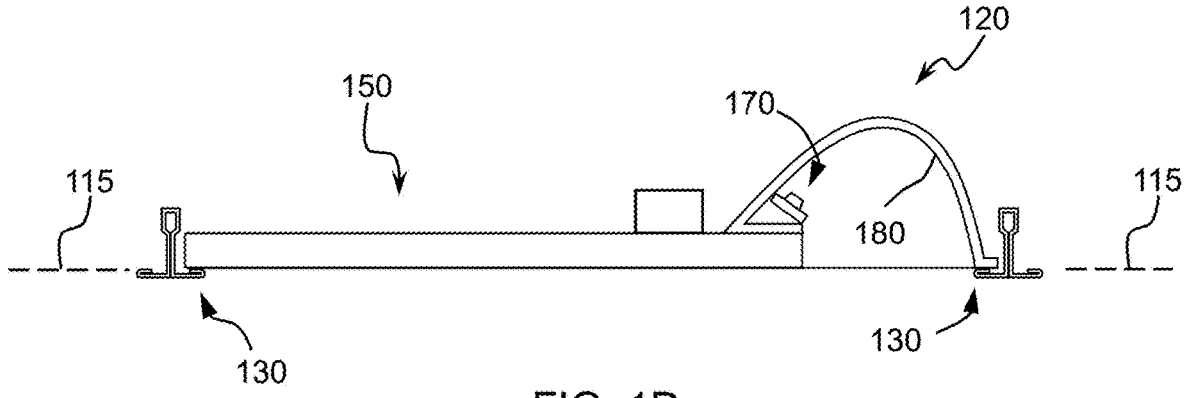
FIG. 1D is a schematic cross sectional side view of the ceiling tile of FIG. 1A in cooperation with elements of a ceiling grid.

In certain embodiments as otherwise described herein, the ceiling tile further includes a contact surface disposed around a perimeter of the ceiling tile, where the contact surface defines the plane of the ceiling. In certain embodiments, the contact surface includes an outer edge of the light housing. Further, in certain embodiments, the contact surface includes a portion of the planar surface of the panel. For example, ceiling tile 100 includes a contact surface 130 that serves to support ceiling tile 100 on the structural members of a ceiling grid or other support surface. The use of contact surface 130 to support ceiling tile 100 is shown in FIG. 1D, where ceiling tile 100 is being supported by two T-beams of a ceiling grid along the contact surface 130 of the tile. Contact surface 130 is disposed around the outer perimeter 132 of the tile and includes both an outer edge 134 of linear light housing 120 and also an outer portion of the planar surface 154 of panel 150. In particular, contact surface 130 includes a portion of planar surface 154 that includes a section near edge 111 of the ceiling tile and sections along the opposing side edges 112, 113 that run across the width of the tile (shown in FIG. 1B). Because contact surface 130 of ceiling tile 100 is supported by elements of a ceiling grid, the contact surface 130 defines the plane 115 of the ceiling in which ceiling tile 100 is installed.

Figure 5:
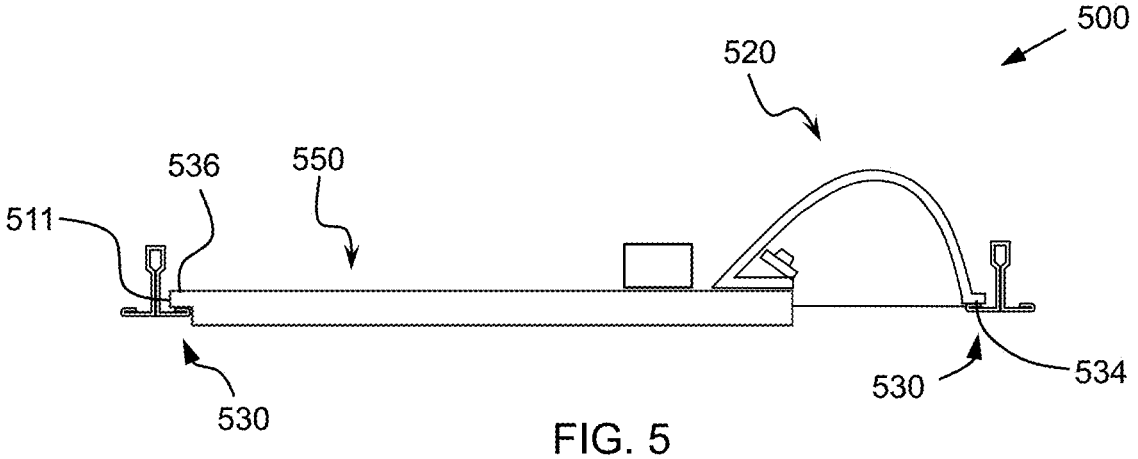
FIG. 5 is a schematic cross sectional side view of a ceiling tile according to another embodiment of the disclosure in cooperation with elements of a ceiling grid.

In certain embodiments as otherwise described herein, the contact surface includes a lower surface of a projection extending from an outer edge of the panel. For example, ceiling tile 500, shown in FIG. 5, includes a projection 536 that extends outward at the outer edge of panel 550. The projection 536 forms a portion of the contact surface 530 that supports ceiling tile 500 on the T-beams of the ceiling grid. The contact surface 530 of ceiling tile 500 also includes the outer edge 534 of the light housing 520. While the cross-sectional view in FIG. 5 only shows the projection 536 at edge 511, it should be understood that panel 550 includes the projection 536 along the side edges of tile 500 as well. Of course it is also possible to restrict the projection to only certain areas of the outer edge of the panel. The projection 536 of ceiling tile 500 is not included on the inside edge of the panel 550 adjacent to the light housing 520. However, in certain embodiments, the projection extends around the entire perimeter of the panel.

Figure 6:
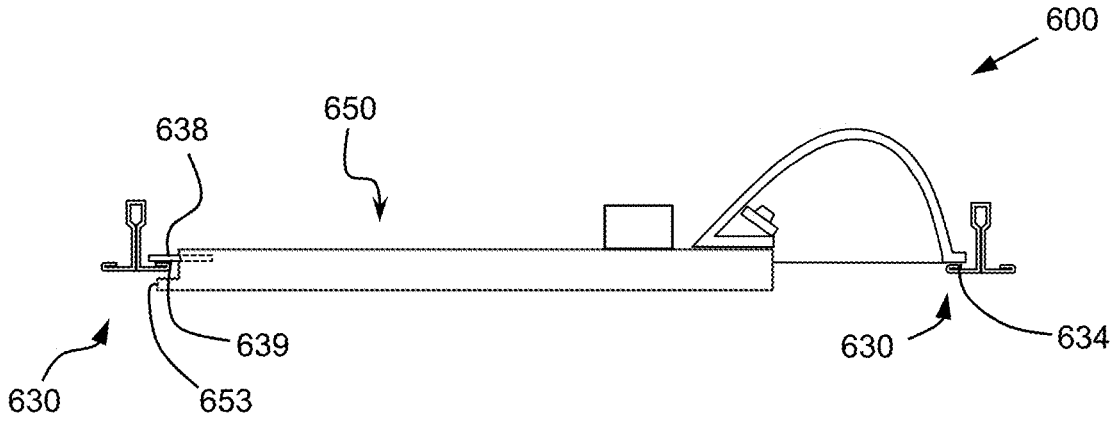
FIG. 6 is a schematic cross sectional side view of a ceiling tile according to another embodiment of the disclosure in cooperation with elements of a ceiling grid.

In certain embodiments as otherwise described herein, the ceiling tile further includes at least one clip attached to the panel, and the contact surface includes a surface of the at least one clip. For example, ceiling tile 600, depicted in FIG. 6, includes clip 638 attached to panel 650. Clip 638 extends outward from an outer edge of panel 650 and provides a surface 639 that is supportable by the T-beam of the ceiling grid. As a result, surface 639 forms a portion of the contact surface 630 of ceiling tile 600, which also includes outer edge 634 of the linear light housing 620. Clip 638 is attached to ceiling tile 600 by friction resulting from the clip being inserted into the body 652 of panel 650. In other embodiments the clip is attached to the panel using an adhesive or a separate fastener. The depicted cross section of ceiling tile 600 only shows one clip 638 at outer edge 611. However, ceiling tile 600 also includes a second clip along outer edge 611 for stability. In other embodiments, clips are also included along the side edges of the ceiling tile, where these additional clips also form portions of the contact surface. The use of clip 638 allows the panel 650 of tile 600 to include an outward flange 653 that obscures a portion of the ceiling grid.

In certain embodiments as otherwise described herein, the ceiling tile is rectangular. For example, ceiling tile 100, shown in FIGS. 1A to 1D, is rectangular with a width 102 and a breadth 104 that are equal in length (and thus, ceiling tile 100 is a square). The width 102 of ceiling tile 100 extends from edge 110 to edge 111 and the breadth 104 extends from edge 112 to edge 113. In other embodiments, the ceiling tile has other shapes, such other polygons or closed curves. For example, one embodiment of a ceiling tile is a triangle where the linear light housing extends along one edge. In such an embodiment, where the shape has an odd number of sides, the width of the tile extends from one edge to an opposing point of the ceiling tile. Of course, other shapes such as pentagons, hexagons, octagons, circles, ellipses and ovals are also possible.

In certain embodiments as otherwise described herein, the width of the ceiling tile is in a range of 20 to 30 inches, e.g., 23 to 25 inches. In certain embodiments, the ceiling tile has a breadth in a range of 20 to 60 inches, for example a breadth in a range of 20 to 30 inches, such as 23 to 25 inches, or a breadth is in a range of 40 to 60 inches, such as 46 to 50 inches.

In certain embodiments as otherwise described herein, the first portion of the width of the ceiling tile is at least 5 percent of the width of the ceiling tile, e.g., at least 12 percent. In certain embodiments, the first portion is no more than 30 percent of the width of the ceiling tile, e.g., no more than 20 percent.

Figure 7:
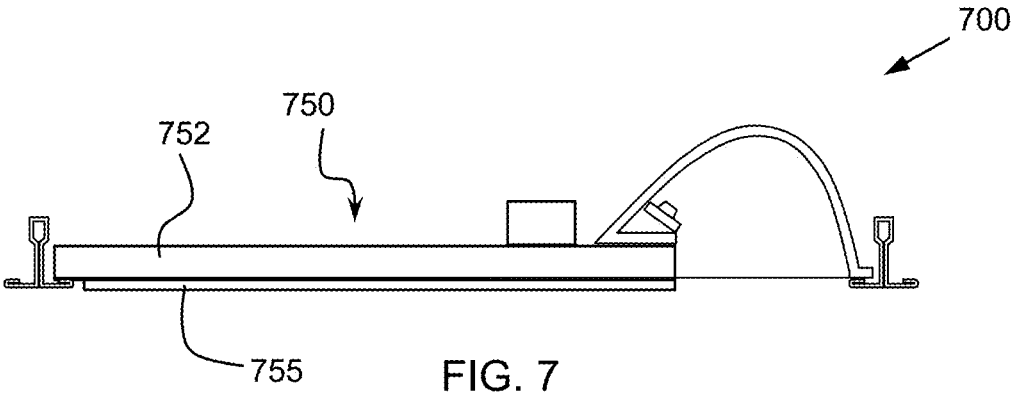
FIG. 7 is a schematic cross sectional side view of a ceiling tile according to yet another embodiment of the disclosure in cooperation with elements of a ceiling grid.

In certain embodiments as otherwise described herein, the body of the panel is composed of at least one of fiberglass, paper, stone wool, slag wool, perlite, metal, wood, and gypsum board. For example, in one embodiment, the body of the panel includes a combination of wood and metal. In certain embodiments, the body of the panel is composed of one of fiberglass, paper, stone wool, slag wool, perlite, metal, wood, or gypsum board. For example, ceiling tile 100, shown in FIGS. 1A to 1D has a panel 150 with a body 152 made of gypsum board. As will be understood by those of ordinary skill in the art, the particular composition of the panel of the ceiling tile can be formed from a wide range of materials and combinations of materials In certain embodiments as otherwise described herein, the panel includes a facing disposed on a lower side of the body. In certain embodiments, the facing comprises at least one of fiberglass, paint, veneer, or paper. For example, ceiling tile 700 in FIG. 7 has a veneer facing 755 disposed on the lower surface of the body 752 of panel 750. The use of a facing can provide a variety of different functions. For example, the facing can provide ornamentation, such as veneer facing 755 of tile 700. In addition, the facing can provide structure to the panel, as with a paper facing on a gypsum tile. In certain embodiments as otherwise described herein, the facing extends over at least a portion of the opening of the light housing. In certain embodiments, the material of the facing has properties that disperse and/or reflect the light from the light housing, either directly as the light passes through the facing, or as reflected from the surrounding room. In other embodiments the facing provides other advantageous features as will be understood by those of ordinary skill in the art.

In certain embodiments as otherwise described herein, the planar surface extends across a majority of the panel. For example, planar surface 154 of tile 100 extends across the entirety of panel 150. In other embodiments, the panel includes grooves or indents that interrupt the planar surface on the panel body. In such a case, the planar surface nonetheless extends over a majority of the panel. In still other embodiments, the planar surface covers less than a majority of the panel.

Figure 8:
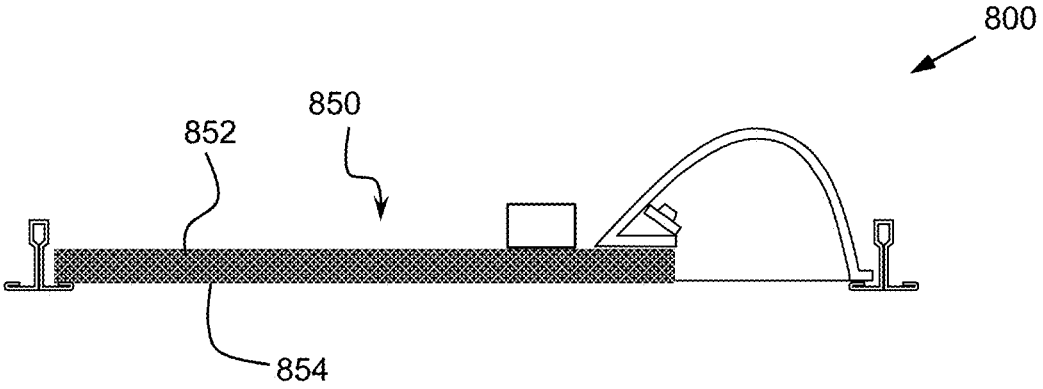
FIG. 8 is a schematic cross sectional side view of a ceiling tile according to still another embodiment of the disclosure in cooperation with elements of a ceiling grid.

In certain embodiments as otherwise described herein, the planar surface has a texture imparted by a material of the panel body. For example, ceiling tile 800 in FIG. 8 has a panel 850 with a body 852 formed of slag wool. As a result, the outside surfaces of the panel have a texture imparted by the slag wool. Accordingly, the planar surface 854 on the lower side of body 852 also has the texture. Nonetheless, the plane of the surface is evident from the common lower boundary of the slag wool material, as will be evident to those of ordinary skill in the art.

In certain embodiments as otherwise described herein, the panel has a thickness of at least 1/16 of an inch, e.g., 1/8 of an inch. In certain embodiments, the panel has a thickness of at least 1/4 inch, e.g., at least 5/8 inch. Likewise, in certain embodiments, the panel has a thickness of no more than 3 inches, e.g., no more than 2 inches.

In certain embodiments as otherwise described herein, the light housing spans a breadth of the ceiling tile. For example, linear light housing 120 of ceiling tile 100 extends from edge 112 on one side of the ceiling tile to edge 113 at the opposite side of the ceiling tile. In other embodiments, the linear light housing extends across only a portion of the breadth of the ceiling tile. For example, in certain embodiments, the linear light housing extends across a central portion of the breadth of the ceiling tile, and is spaced apart from the side edges. In other embodiments, the light housing extends from one side across a majority of the breadth of the ceiling tile but stops short of the opposing side edge. Such a ceiling tile could be paired with another ceiling tile having a mirror image configuration so that the pair of light housings forms one elongate light. In still other embodiments, sections of light housing extend from both side edges of the ceiling tile but leave a central portion of the ceiling tile without any light housing.

Figure 10:
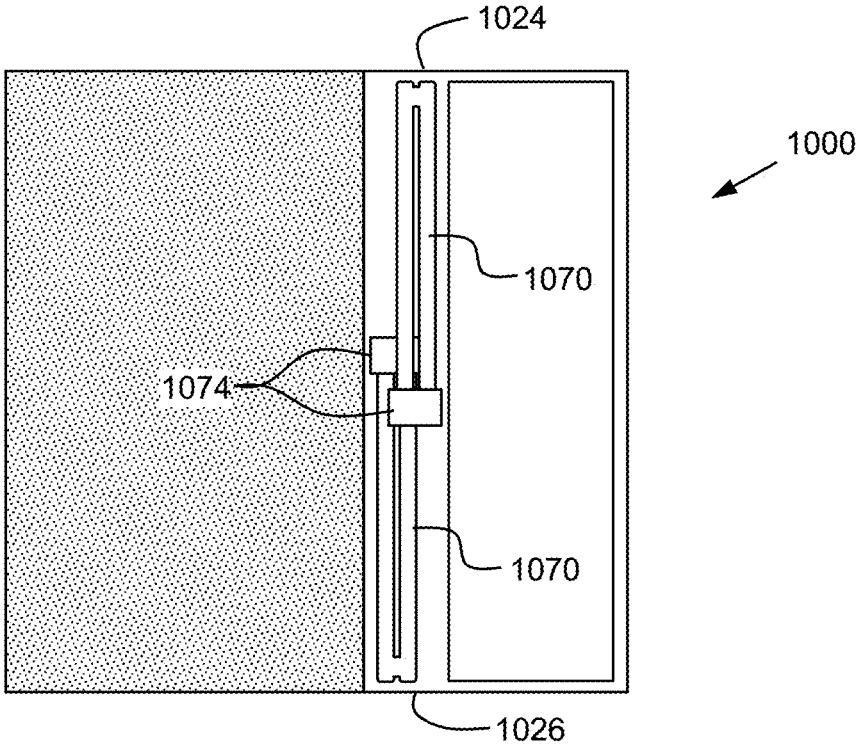
FIG. 10 is a schematic cross sectional top view of a ceiling tile according to another embodiment of the disclosure.

In certain embodiments as otherwise described herein, the light housing includes an elongate wall and first and second end walls. For example, linear light housing 120 of ceiling tile 100, as most clearly depicted in FIG. 10, includes elongate wall 122 extending from end wall 124 to end wall 126. Elongate wall 122 extends across the entire breadth 104 of ceiling tile 100 where it meets end walls 124 and 126 at respective side edges 112 and 113 of the ceiling tile. Elongate wall 122 is curved along the width direction of ceiling tile 100 providing an enclosure of the housing 120. As described in more detail below, the curved elongate wall forms a reflector of linear light housing 120. In other embodiments, the elongate wall includes one or more planar surfaces that form an enclosure in the shape of a box.

In certain embodiments as otherwise described herein, the light housing includes an opening through which light is emitted. In some embodiments, the opening spans the breadth of the ceiling tile. For example, linear light housing 120 of ceiling tile 100 includes an opening 128, as shown in FIG. 1D, through which light shines down into the area below the ceiling. The opening 128 of linear light housing 120 extends across the entire breadth of ceiling tile 100 from edge 112 to edge 113. As a result, the light from ceiling tile 100 is presented as a long linear light across the entire ceiling tile.

In certain embodiments as otherwise described herein, the opening of the light housing is rectangular. For example, opening 128 is formed as a rectangle between opposing end walls 124, 126 of the linear light housing 120 and between the outer edge 134 of the light housing and the inside edge of panel 150. In other embodiments the opening is in the form of another shape. For example, in some embodiments where the ceiling tile has a shape other than a rectangle, the opening of the light housing may likewise not be rectangular. For example, in some embodiments of a ceiling tile with a triangular shape, the opening of the light housing is in the shape of a trapezoid. In other embodiments the opening is round, as in ceiling tile 200. In certain embodiments the opening is in the shape of an arc, as in ceiling tile 300.

In certain embodiments as otherwise described herein, the opening of the light housing has a width of at least 1 inch, e.g., at least 2 inches, e.g., at least 3 inches. In certain embodiments, the opening of the light housing has a width of no more than 12 inches, e.g., no more than 8 inches. Of course, a person of ordinary skill in the art will appreciate that the opening of the light housing can have other sizes as appropriate based on the size of the tile and the area to be illuminated.

In certain embodiments as otherwise described herein, the ceiling tile includes a light source that cooperates with the light housing. In certain embodiments the light source is disposed in the light housing. Further, in certain embodiments the light source is disposed on an upper side of the panel. For example, in ceiling tile 100, light source 170 is positioned within linear light housing 120 on the inside edge of the housing. As most easily seen in the cross section of FIGS. 1A and 1D, light source 170 is held on a portion of linear light housing 120 that extends over a narrow part of panel 150. As will be appreciated by those of ordinary skill in the art, the light source may be coupled to the light housing using a variety of different methods and structures, such as adhesives, fasteners and/or brackets.

In other embodiments, the light source is remote from the light housing and shines light into the light housing from a distance. For example, in some embodiments the light source is disposed at a far edge of the ceiling tile and shines light into the light housing through an opening therein. In such an embodiment, the light housing serves to redirect the light downward toward the room or space that is covered by the constructed ceiling. In other embodiments, the ceiling tile does not itself include a light source. Instead, light is directed to the light housing from a remote location either directly, or through fiber optics, or by another method as will appreciated by a person of ordinary skill in the art.

In various embodiments, the light source itself is not substantially directly visible from a point under the bottom of the ceiling tile; the light source can instead be configured to shine up onto a reflector, which directs light down to points under the bottom of the ceiling tile. Such configurations are shown throughout the drawings.

In certain embodiments as otherwise described herein, the light source of the ceiling tile includes an array of LEDs. The array of LEDs includes one or more columns of LEDs that provide light along the length of the lighting housing. Because LEDs are small, the array can extend up to the very edge of the lighting housing with individual LEDs located close to the end walls of the housing. In certain embodiments the LEDs in neighboring columns are aligned, while in other embodiments the LEDs in neighboring columns are offset. In certain embodiments, the array includes a single column of LEDs. For example, in ceiling tile 100, the light source 170 is formed by an array of LEDs having only one column. In particular, the LED array in ceiling tile 100 is an LED strip with a plurality of LEDs on a flexible circuit board. In other embodiments, the LEDs are disposed on one or more rigid backing, such as printed circuit boards.

In certain embodiments as otherwise described herein that have a light source with at least one LED, the ceiling tile includes an LED driver disposed on an upper surface of the panel. For example, ceiling tile 100 includes LED driver 172 disposed on the upper surface 156 of panel 150. The LED driver 172 regulates the power to the LEDs of light source 170 in order to provide changing power to the LEDs as their electrical properties change with temperature. Accordingly, the LED driver allows the LEDs to emit a steady stream of light over the course of their operation. As will be appreciated by those of ordinary skill in the art the LED driver can be electrically connected to the LEDs of the LED array in a variety of different manners. For example, the LED driver can be connected by electrical leads to the circuit board or other backing of the LED array, which in turn provides power to the LEDs. As will be appreciated by those of ordinary skill in the art, the LED driver may be attached to the panel using a variety of different methods and structures, such as adhesives, fasteners and/or brackets. In certain embodiments as otherwise described herein, the LED driver is disposed on the light housing. For example, in some embodiments, the light housing includes a platform or other surface on which the LED driver is attached.

In certain embodiments as otherwise described herein, the ceiling tile includes an electronic controller including a memory for storing instructions and a processor to carry out the instructions. For example, in some embodiments the electronic controller includes instructions for operating the light source according to one or more varying lighting schemes as will be appreciated by a person of ordinary skill in the art, such as changing color or varying brightness at different times of the day. In certain embodiments the electronic controller includes one or more sensors that collects data that is stored in the memory and/or used by the processor. For example, in some embodiments the electronic controller includes a light sensor and the processor sends control signals for controlling the light source based on the light sensor. In certain embodiments the electronic controller includes a data transceiver for sending and/or receiving data. For example, in some embodiments the electronic controller includes a wireless data transceiver. As will be appreciated by a person of ordinary skill in the art, the data transceiver can be used to send data collected by the sensors and/or to receive updated instructions for operating the controller. In certain embodiments, the electronic controller is associated with the LED driver, for example, in some embodiments the LED driver is a module of the electronic controller.

In certain embodiments as otherwise described herein, the light source includes one or more fluorescent, halogen or incandescent bulbs. For example, in some embodiments, the light source includes a plurality of small incandescent or halogen bulbs arranged in a line similar to the LEDs of light source 170 in ceiling tile 100. In other embodiments, the light source includes one or two long bulbs that extend along the length of the linear light housing.

In certain embodiments as otherwise described herein that have a light source with at least one fluorescent bulb, the ceiling tile further includes a fluorescent light ballast disposed on an upper surface of the panel. The fluorescent light ballast regulates current to the fluorescent bulb by adding impedance to the circuit of the fluorescent bulb as the voltage drop across the bulb changes. As will be appreciated by those of ordinary skill in the art, the fluorescent light ballast can be electrically connected to the fluorescent bulb in a variety of different manners. For example, the ballast can be connected by electrical leads to a socket that receives the fluorescent bulb. As also will be appreciated by those of ordinary skill in the art, the fluorescent light ballast may be attached to the panel using a variety of different methods and structures, such as adhesives, fasteners and/or brackets.

In certain embodiments as otherwise described herein, the fluorescent light ballast is disposed on the light housing. For example, in some embodiments, the light housing includes a platform or other surface on which the fluorescent ballast is attached. Further, in other embodiments the fluorescent light ballast is integrated with the fluorescent bulb, and a separate ballast is omitted.

Figure 9:
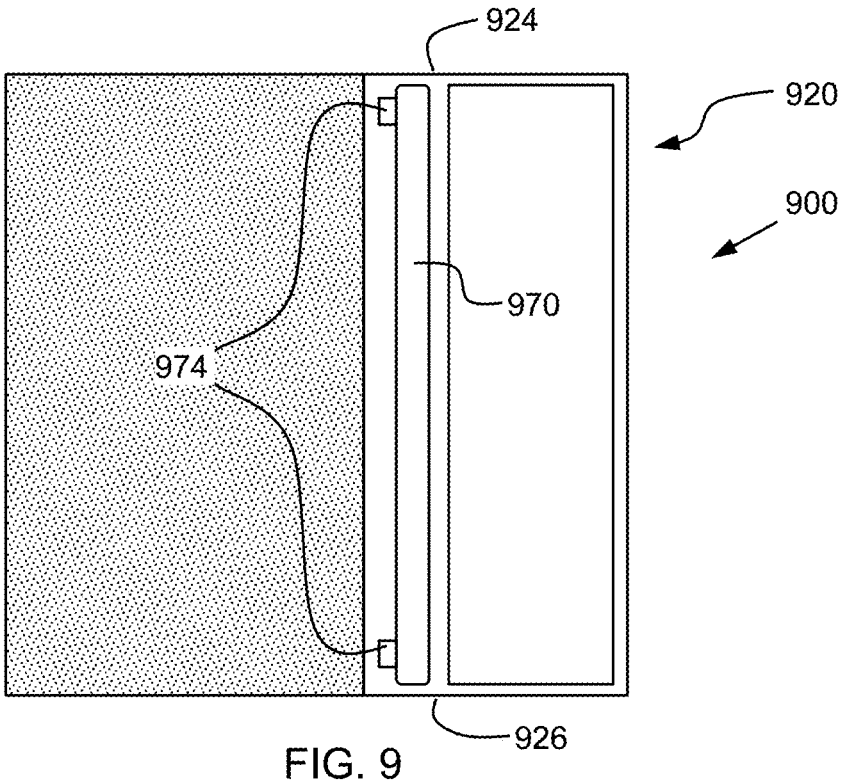
FIG. 9 is a schematic cross sectional top view of a ceiling tile according to an embodiment of the disclosure.

In certain embodiments as otherwise described herein, the light source is configured to emit light through the opening that is substantially uniform along the length of the opening. The term substantially uniform as used herein means a difference in lux of no more than 20% between any two respective square inches of space along the length of the opening of the light housing. In such an embodiment, although the light emission along the length of light housing is substantially uniform, more substantial differences in light emission may be noticed across the width of the opening. The substantially uniform light emission along the length of the light housing can be achieved in a variety of manners. For example, in ceiling tile 100, the column of LEDs of light source 170 extend up to the end walls 124, 126 of the linear light housing 120, such that light of similar intensity is emitted along the entire length of the linear light housing 120. In certain embodiments, the light source includes an electrical connector and the electrical connector is disposed on a long side of the light source. For example in ceiling tile 900 shown in FIG. 9, the light source includes a linestra bulb with an electrical connector 974 including two sockets that are disposed at either end of the bulb on the side of the bulb. This allows the bulb itself to extend up to the end walls 924, 926 of light housing 920. In certain embodiments, the light source includes an electrical connector and the electrical connector is not disposed at an end of the light housing. For example, in ceiling tile 1000 shown in FIG. 10, the light source 1070 includes two twin tube compact fluorescent bulbs that extend outward from a center of the light housing 1020. The electrical connector 1074 includes two sockets disposed at the center of the light housing. This allows the distal ends of the bulbs, which emit light, to be positioned near the end walls 1024, 1026 of the linear light housing 1020 and provide uniform light across the entire housing.

In certain embodiments, the ceiling tile further includes a light reflector disposed in the light housing. For example, the elongate wall 122 of linear light housing 120 of ceiling tile 100 serves as the light reflector 180. Reflector 180 redirects the light that is shining at an upward angle from the LEDs of light source 170 downward through an opening 128 into the room that is covered by the ceiling tile.

While the reflector 180 forms the elongate wall 122 of linear light housing 120 in the embodiment of ceiling tile 100, in other embodiments the reflector is separate from the wall of the housing and disposed inside the light housing. For example, in certain embodiments the light reflector includes a film, coating, or glass layer disposed over the wall of the light housing. In other embodiments, the reflector is spaced from the wall of the housing. For example, in some embodiments the reflector is a glass or metal sheet separate from the housing wall and disposed in the lighting housing. In certain embodiments the reflector and the panel are formed of the same material, e.g., metal or gypsum.

In certain embodiments as otherwise described herein, the light reflector is formed of metal, e.g., steel or aluminum. In other embodiments, the light reflector is formed of plastic, e.g., acrylic, polycarbonate, an acrylonitrile/butadiene/styrene polymer (ABS) or polyethylene terephthalate (PET). The reflector need not have a mirrored surface; in many embodiments the reflector will act to diffuse the light that it reflects. Still in other embodiments the light reflector is formed of glass.

In certain embodiments as otherwise described herein, the light housing includes an opening, and the light reflector faces the opening. In certain embodiments, the light reflector is curved and concave. For example, light reflector 180 of ceiling tile 100 is positioned over opening 128 and has a concave curve that directs a large portion of the light emitted from light source 170 through opening 128. As will be appreciated by those of ordinary skill in the art, the angle of the light source and the curve of the reflector can be tailored so that the reflector redirects light that is spreading from the light source over a range of angles.

In certain embodiments as otherwise described herein, the light reflector is at an angle to the plane of the ceiling. For example, in some embodiments the light reflector is flat and is positioned at an appropriate angle to direct light from the light source through the opening of the light housing and into the room.

In certain embodiments as otherwise described herein, the light reflector is a diffuse reflector. The diffuse reflector scatters light from the light source to reflect the light over a range of angles. In certain embodiments the light source is non-diffuse. For example, in some embodiments the light source is formed by one or more incandescent bulbs that emit light from a filament. The filament provides the light from a point or a very small area. The diffuse reflector softens the light by spreading it over a larger area before it is directed into the room below the ceiling tile. In certain embodiments the reflector has a multi-faceted surface to spread the light, while in other embodiments the reflector has a smooth surface.

In certain embodiments as otherwise described herein, the light reflector includes a diffuse paint. In some embodiments the light reflector includes a roughened metal surface. In other embodiments the light reflector is formed of a white plastic, e.g., white PET or ABS.

In certain embodiments the light reflector is not a diffuse reflector. For example, in certain embodiments the light reflector has a mirror-like surface. In some of these embodiments the light source is configured to shine diffuse light onto the light reflector. Accordingly, while most of the reflection of the mirror-like surface of the reflector is specular, the diffuse light source provides light that is spread over a larger area to avoid the appearance of a point light source. For example, in certain embodiments as otherwise described herein, the light source includes a diffuser that spreads the light evenly over the light reflector.

Figure 11:
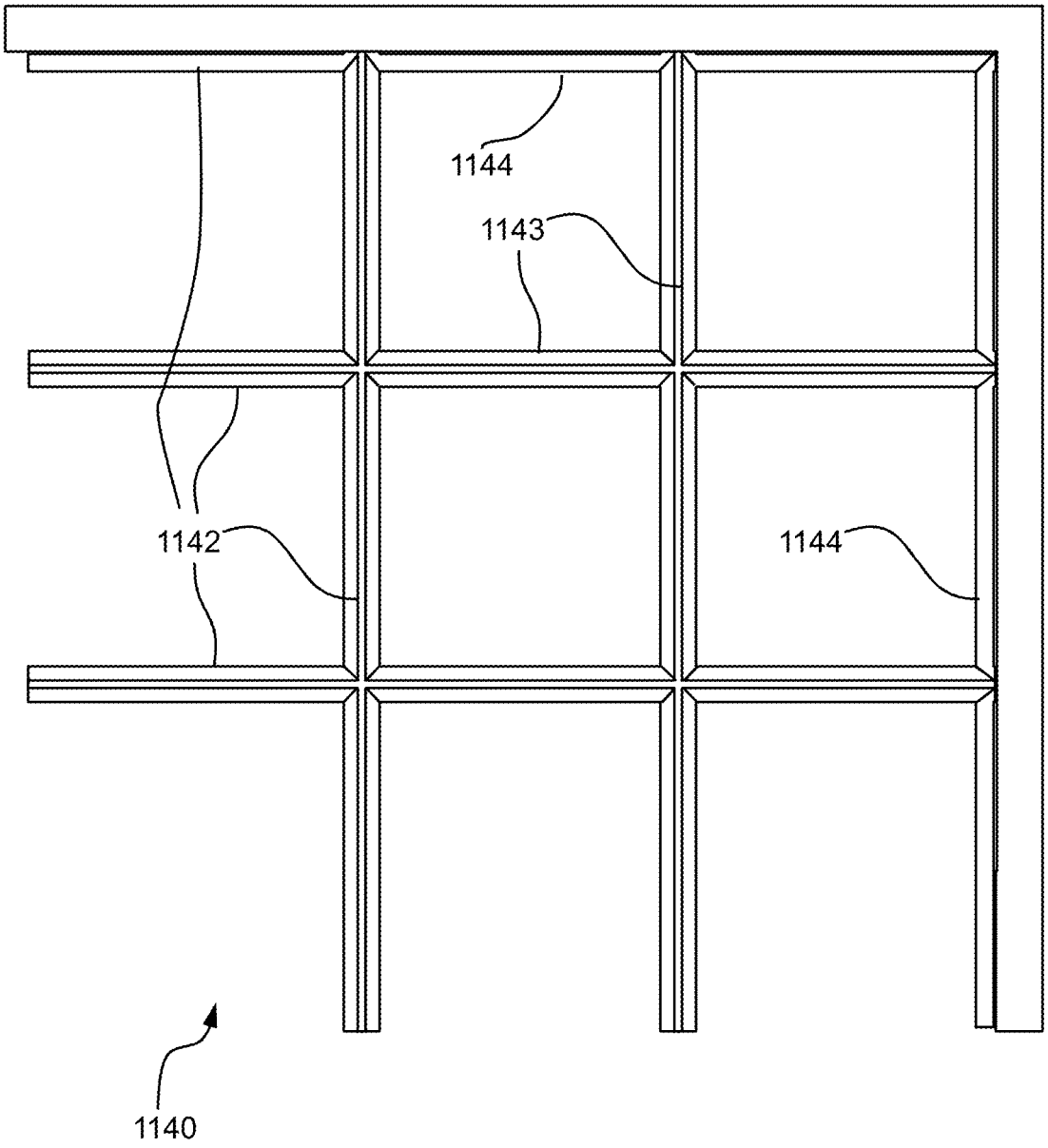
FIG. 11 is a schematic top view of a ceiling grid of a ceiling system according to an embodiment of the disclosure.
Figure 12:
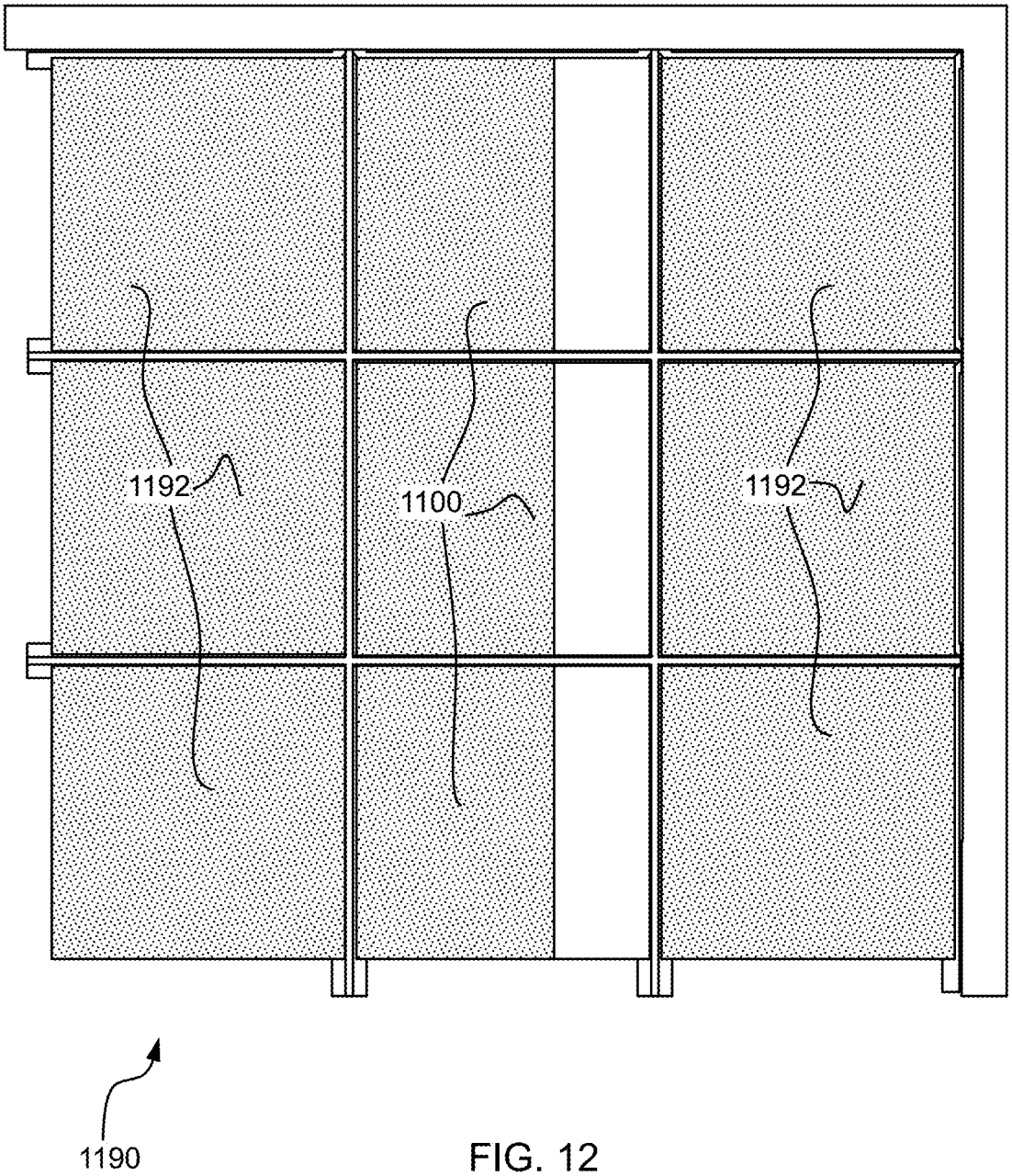
FIG. 12 is a schematic top view of the ceiling system of FIG. 11 including ceiling tiles.
Figure 13:
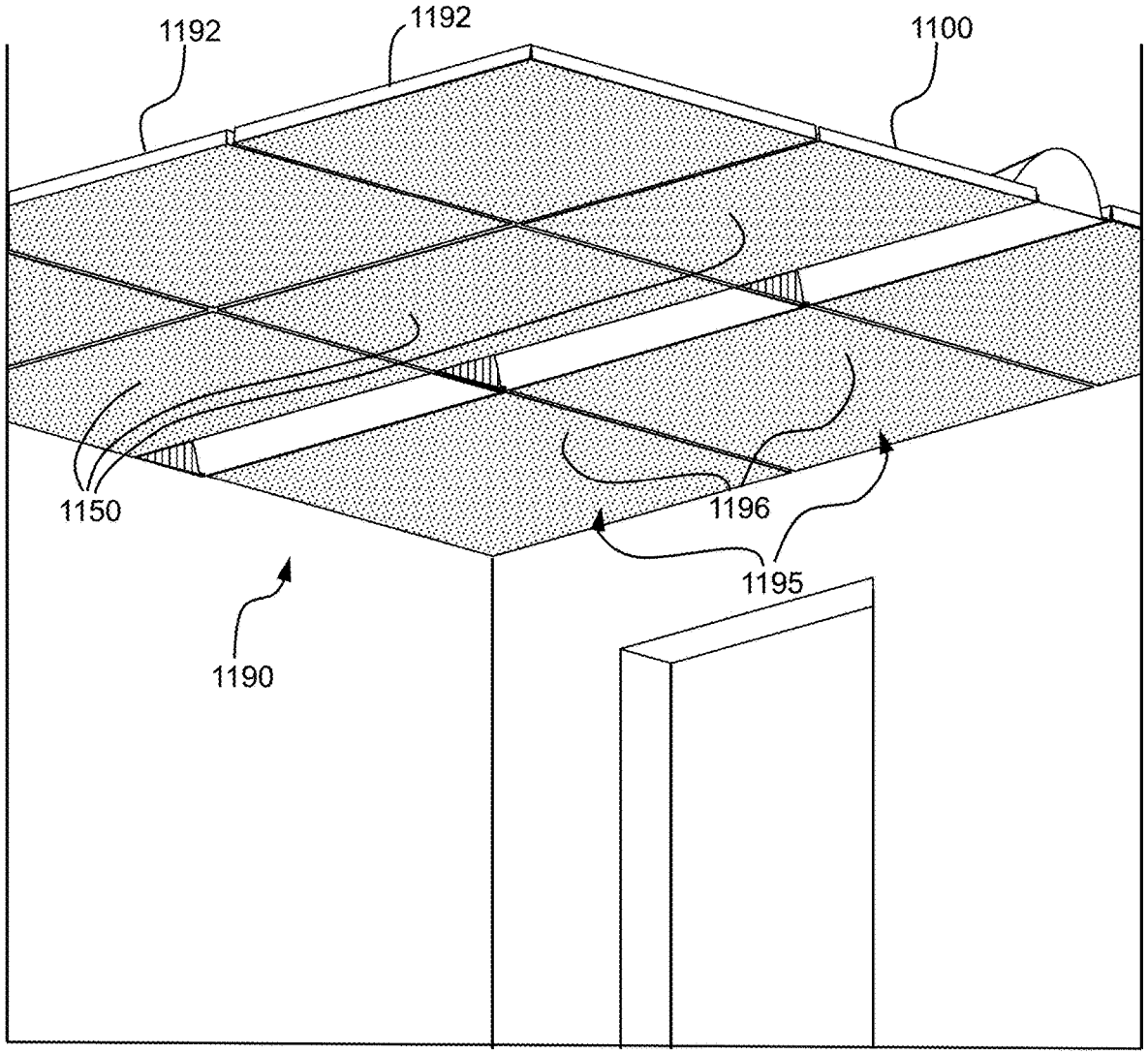
FIG. 13 is a schematic perspective bottom view of the ceiling system of FIGS. 11 and 12.
Figure 14:
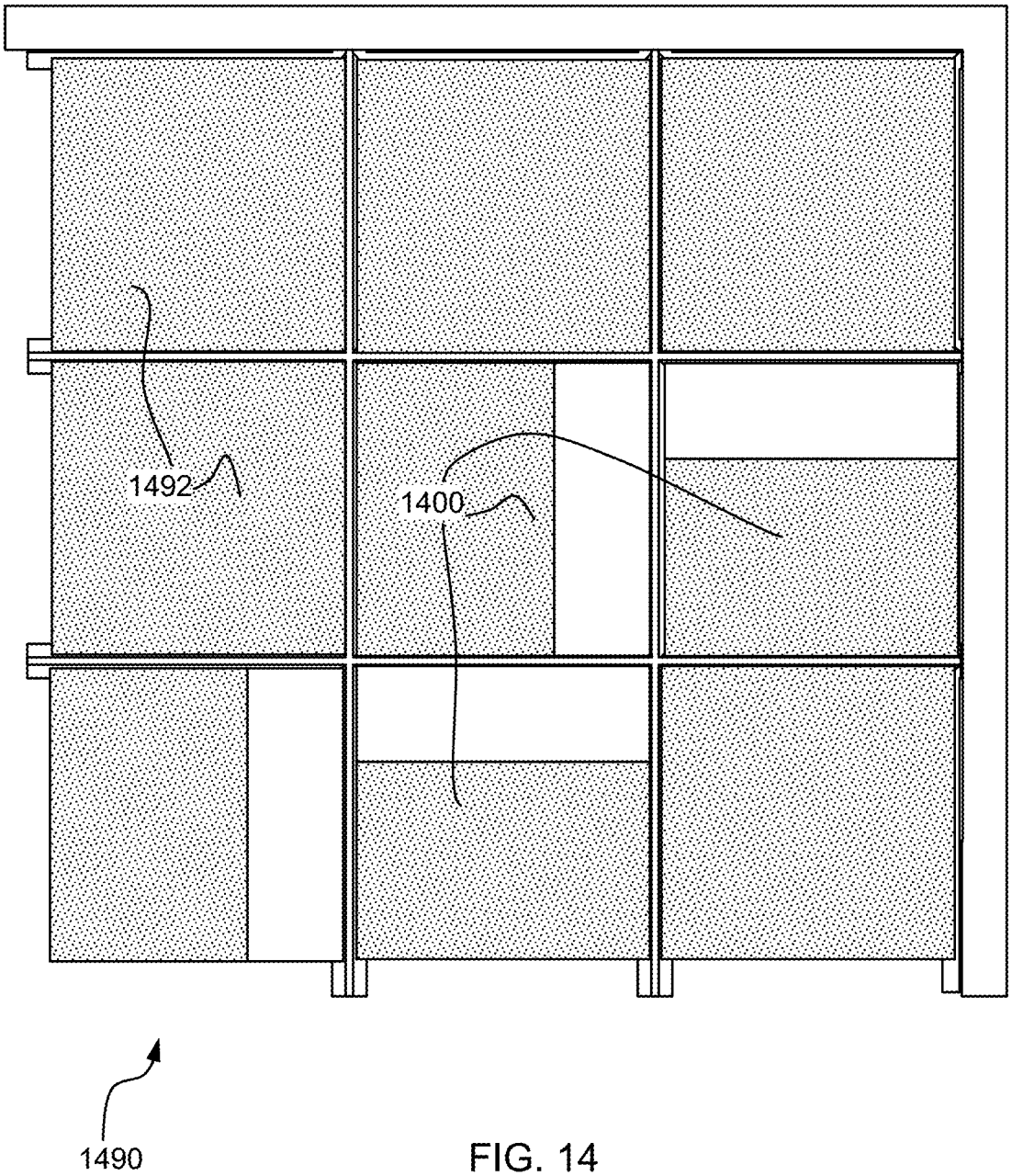
FIG. 14 is a schematic top view of a ceiling system according to another embodiment of the disclosure.
Figure 15:
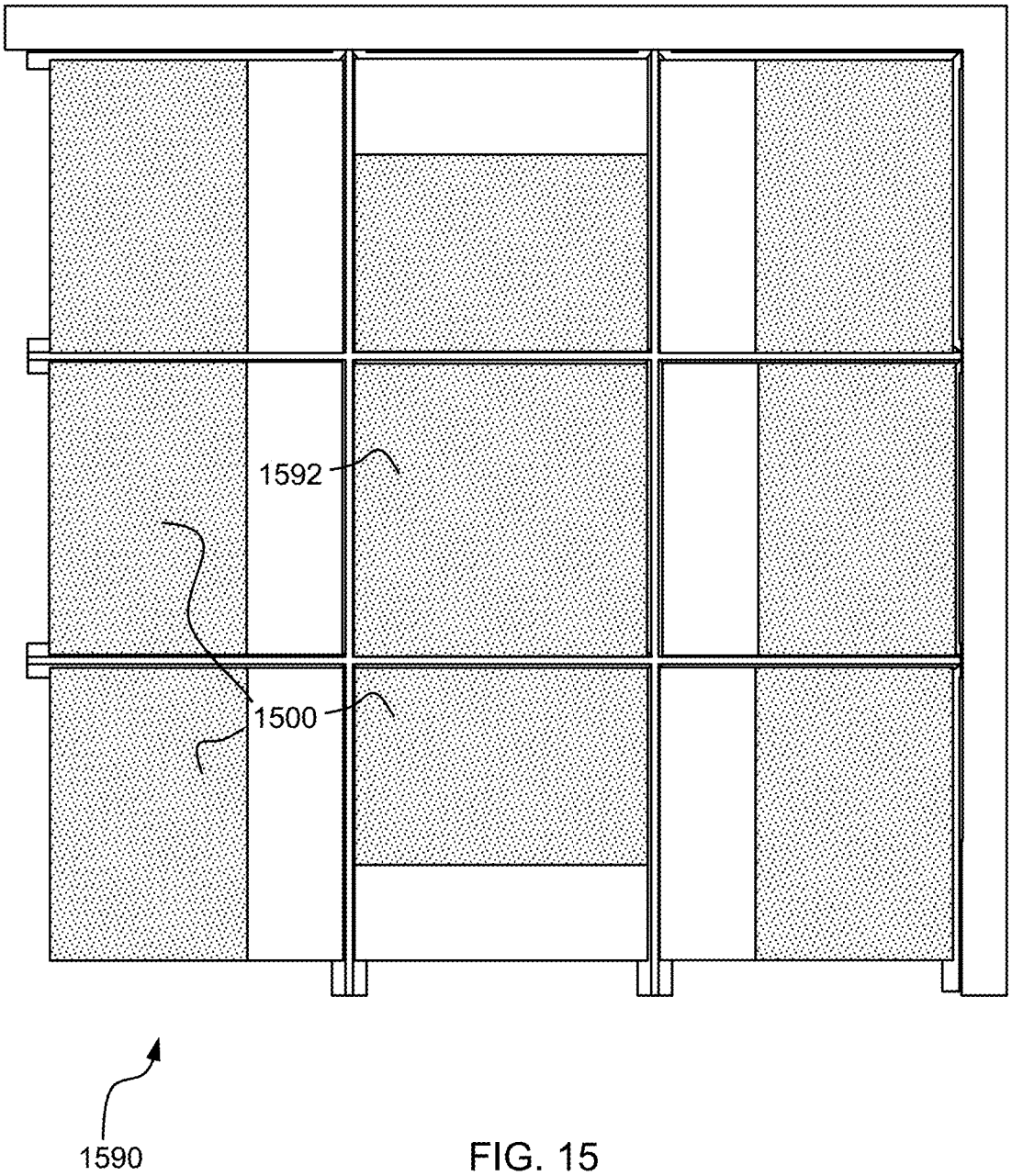
FIG. 15 is a schematic top view of a ceiling system according to another embodiment of the disclosure.

Another aspect of the present disclosure is a ceiling system including a ceiling grid having a plurality of beams that define a plane of the ceiling, a plurality of first ceiling tiles supported by the ceiling grid, and one or more second ceiling tiles with an integrated light in accordance with any of the embodiments described above. Such a system is shown in FIGS. 11 to 13, which shows a portion of the system in the corner of a room adjacent to two perpendicular adjoining walls. Ceiling system 1190 includes a ceiling grid 1140 (most clearly shown in the schematic top view of FIG. 11) that includes a plurality of beams 1142 extending in perpendicular directions from the supporting walls. The beams 1142 include T-beams 1143 that span the room and channels 1144 that are adjacent to the supporting walls. The beams 1142 are arranged in a perpendicular grid and provide openings that hold respective ceiling tiles. Ceiling system 1190 includes two groups of ceiling tiles: a group of first ceiling tiles 1192 that are conventional flat ceiling tiles, and a group of second ceiling tiles 1100 that each include an integrated linear light similar to ceiling tile 100 discussed above. The ceiling tiles are schematically depicted in the top view of FIG. 12 and the bottom perspective view of FIG. 13.

In certain embodiments as otherwise described herein, each first ceiling tile includes a panel that is coplanar with the panel of the second ceiling tiles. Further, in certain embodiments, the panel of each first ceiling tile includes a planar surface, and wherein the planar surface of each first ceiling tile is coplanar with the planar surface of the second ceiling tile. For example, first ceiling tiles 1192 include panels 1195 that are coplanar with the panels 1150 of second ceiling tiles 1100, and specifically include planar surfaces 1196 that are coplanar with the planar surfaces 1154 of second tiles 1100. As a result, the panels 1195, 1150 of the ceiling tiles form a continuous planar ceiling surface that extends across the majority of the room, except where the linear lighting is provided by second ceiling tiles 1100.

In certain embodiments as otherwise described herein, the panel of each first ceiling tile extends across an entire width of the respective ceiling tile. For example, in contrast to the panels 1150 of second ceiling tiles 1100, which extend across only a portion of the respective tile's width, the panels 1195 of first tiles 1192 span the entire width of the tile.

In certain embodiments as otherwise described herein, each first ceiling tile is rectangular and has a width and a breadth, and each second ceiling tile is rectangular and has a width and a breadth that is the same as the width and the breadth of the first ceiling tiles. For example, the first ceiling tiles 1192 and second ceiling tiles 1100 are all squares of the same size, and thus have the same respective breadth and width. Accordingly, the first and second ceiling tiles 1192, 1100 can easily be moved to different openings in the ceiling grid, allowing simple modification of the ceiling system 1190.

In certain embodiments as otherwise described herein, the second ceiling tile is removable from the ceiling grid by lifting the second ceiling tile. For example, second ceiling tile 1100 can be removed from the ceiling grid 1140 by simply lifting the tile up and out of the opening in the grid. The complete decoupling of the second ceiling tile 1100 from the ceiling system 1190 requires disconnecting electrical connections to the ceiling tile. However, removing tile 1100 does not require removal of any metal fasteners or any portion of the grid.

In certain embodiments as otherwise described herein, the second ceiling tile includes a contact surface disposed around a perimeter thereof, and the contact surface is supported by the beams of the ceiling grid. In certain embodiments, the beams of the ceiling grid include T-beams, and the contact surface of the second ceiling tile rests on flanges of a portion of the beams of the ceiling grid. For example, grid 1140 of ceiling system 1190 includes rows and columns of T-beams 1143 that form openings to hold the ceiling tiles. In particular, the flanges of the T-beams (see FIG. 11) form a square surface that supports the contact surface around the perimeter of the ceiling tiles. (A cross section of the flanges of opposing T-beams supporting a ceiling tile is shown in FIG. 1.)

In certain embodiments as otherwise described herein, each tile in the group of second ceiling tiles is disposed adjacent to at least one other tile in the group of second ceiling tiles. In certain embodiments, the tiles in the group of second ceiling tiles are disposed in a line within the ceiling grid. For example, in ceiling system 1190, three second ceiling tiles 1100 form a group that is disposed in a straight line within the ceiling grid 1140. In other embodiments, the second ceiling tiles are organized in a cluster, for example with the linear light housings forming a pinwheel configuration. In certain embodiments, the tiles in the group of second ceiling tiles are disposed in a meandering path. For example, in ceiling system 1490, the second ceiling tiles 1400 are each disposed adjacent to another second ceiling tile 1400 to form a path of ceiling tiles. In other embodiments, the tiles in the group of second ceiling tiles are disposed in a loop. For example, in ceiling system 1590, the second ceiling tiles 1500 are arranged in a loop of eight tiles. While the loop in ceiling system 1590 surrounds a conventional ceiling tile 1592, in other embodiments the loop of second ceiling tiles is compact and does not surround any other tiles.

In certain embodiments as otherwise described herein, the tiles in the group of second ceiling tiles have the same orientation, such that the respective light housings form a continuing linear light across the group of second ceiling tiles. For example, second ceiling tiles 1100 in ceiling system 1190 are arranged in a line where each tile is rotated in the same direction. As a result, the linear light housings combine to form one continuous linear light crossing a portion of the room.

In certain embodiments as otherwise described herein, the tiles in the group of second ceiling tiles are oriented to form a continuing path of light among the group of second ceiling tiles. For example, in ceiling system 1490, the tiles are arranged adjacent to one another in a path and the light housings of the tiles are oriented to form a continuing path of light in a staircase pattern across the group of second ceiling tiles 1400.

In certain embodiments as otherwise described herein, the tiles in the group of second ceiling tiles are oriented to form a continuous loop of light among the second ceiling tiles. For example, in ceiling system 1590, the second ceiling tiles 1500 are arranged in a loop and are oriented so that the light housings also form a loop. Accordingly, when illuminated, the group of second ceiling tiles 1500 forms a continuous loop of light in the ceiling.

Another aspect of the present disclosure is a method of installing ceiling tiles in a ceiling that includes: providing a ceiling grid including a plurality of beams defining a plane and arranged to provide a plurality of openings for ceiling tiles; placing a plurality of first ceiling tiles in a first portion of the openings; and placing one or more second ceiling tiles in at least one other opening in the ceiling grid so as to form a ceiling system according to any of the embodiments described above.

Another aspect of the present disclosure is a method of installing ceiling tiles in a ceiling, the method comprising: providing a ceiling grid including a plurality of beams defining a plane and arranged to provide a plurality of openings for ceiling tiles; placing a first ceiling tile in a first opening in the ceiling grid; placing a second ceiling tile in a second opening in the ceiling grid, where the second ceiling tile is one including an integrated light as described in any of the embodiments above.

In certain embodiments as otherwise described herein, the method includes placing an additional second ceiling tile in a third opening adjacent to the second opening. In certain embodiments, the method includes positioning the second ceiling tiles to form a continuing linear light using the respective linear light housings. For example, second ceiling tiles 1100 in ceiling system 1190 were each rotated in the same manner before being placed within respective openings in the ceiling grid. Accordingly, the second ceiling tiles 1100 form a linear light across all three tiles.

In certain embodiments as otherwise described herein, the method includes placing a group of second ceiling tiles in respective adjacent openings in the ceiling grid. In certain embodiments, the method includes orienting the group of second ceiling tiles to form a continuing path of light among the second ceiling tiles. For example, as the tiles in ceiling system 1490 are placed into the ceiling grid, the second ceiling tiles 1400 are oriented form a continuing path of light in a staircase pattern across the group of second ceiling tiles 1400. In other embodiments, the method includes orienting the group of second ceiling tiles to form a continuous loop of light among the second ceiling tiles. For example, as the tiles in ceiling system 1590 are placed into ceiling grid the second ceiling tiles 1500 are oriented to form a continuous loop of light around ceiling tile 1592.

In certain embodiments as otherwise described herein, placing the second ceiling tile in the second opening includes lowering the second ceiling tile onto a group of the plurality of beams. For example, the second ceiling tile with the integrated light can be installed in the ceiling through the simple act of dropping the tile into the appropriate opening. Thus, attractive lighting, e.g., linear lighting, can be constructed without the need for building customized ceiling grid to accommodate the lighting, or for attaching linear lighting fixtures to the grid using metal fasteners. Instead, the light can be constructed as simply as installing ceiling tiles and providing an electrical connection to any corresponding light source.

Various aspects of the disclosure are further described by the following enumerated embodiments, which can be combined in any number and in any fashion that is not technically or logically inconsistent.

Embodiment 1

A ceiling tile comprising:

a light housing extending across a first portion of a width of the ceiling tile; and a panel extending across a remaining portion of the width of the ceiling tile.

Embodiment 2

The ceiling tile according to Embodiment 1, wherein the light housing is a linear light housing.

Embodiment 3

The ceiling tile according to Embodiment 1 or Embodiment 2, wherein the light housing extends from a first edge of the ceiling tile.

Embodiment 4

The ceiling tile according to Embodiment 1, wherein the light housing is nonlinear.

Embodiment 5

The ceiling tile according to any of Embodiments 1 to 4, wherein the panel includes a body having a planar surface.

Embodiment 6

The ceiling tile according to Embodiment 5, wherein the planar surface is parallel to a plane of the ceiling.

Embodiment 7

The ceiling tile according to any of Embodiments 1 to 6, further comprising a contact surface disposed around a perimeter of the ceiling tile, the contact surface defining the plane of the ceiling.

Embodiment 8

The ceiling tile according to Embodiment 7, wherein the contact surface includes an outer edge of the light housing.

Embodiment 9

The ceiling tile according to Embodiment 7 or Embodiment 8, wherein the panel includes a planar surface and wherein the contact surface includes a portion of the planar surface of the panel.

Embodiment 10

The ceiling tile according to any of Embodiments 7 to 9, wherein the contact surface includes a lower surface of a projection extending from an outer edge of the panel.

Embodiment 11

The ceiling tile according to any of Embodiments 7 to 10, further comprising at least one clip attached to the panel, and wherein the contact surface includes a surface of the at least one clip.

Embodiment 12

The ceiling tile according to any of Embodiments 1 to 11, wherein the ceiling tile is rectangular.

Embodiment 13

The ceiling tile according to any of Embodiments 1 to 12, wherein the width is in a range of 20 to 30 inches, e.g., 23 to 25 inches.

Embodiment 14

The ceiling tile according to any of Embodiments 1 to 13, wherein the ceiling tile has a breadth in a range of 20 to 60 inches.

Embodiment 15

The ceiling tile according to any of Embodiments 1 to 14, wherein the breadth is in a range of 20 to 30 inches, e.g., 23 to 25 inches.

Embodiment 16

The ceiling tile according to any of Embodiments 1 to 15, wherein the breadth is in a range of 40 to 60 inches, e.g., 46 to 50 inches.

Embodiment 17

The ceiling tile according to any of Embodiments 1 to 16, wherein the first portion is at least 5 percent of the width of the ceiling tile, e.g., at least 12 percent.

Embodiment 18

The ceiling tile according to any of Embodiments 1 to 17, wherein the first portion is no more than 30 percent of the width of the ceiling tile, e.g., no more than 20 percent.

Embodiment 19

The ceiling tile according to any of Embodiments 1 to 18, wherein the panel includes a body composed of at least one of fiberglass, paper, stone wool, slag wool, perlite, metal, wood, and gypsum board.

Embodiment 20

The ceiling tile according to any of Embodiments 1 to 19, wherein the panel includes a body composed of one of fiberglass, paper, stone wool, slag wool, perlite, metal, wood, or gypsum board.

Embodiment 21

The ceiling tile according to any of Embodiments 1 to 20, wherein the panel includes a facing material disposed on a lower side of the body.

Embodiment 22

The ceiling tile according to Embodiment 21, wherein the facing material comprises at least one of fiberglass, paint, veneer or paper.

Embodiment 23

The ceiling tile according to any of Embodiments 1 to 22, wherein the panel includes a planar surface that extends across a majority of the panel.

Embodiment 24

The ceiling tile according to any of Embodiments 1 to 23, wherein the panel includes a planar surface that has a texture imparted by a material of the panel body.

Embodiment 25

The ceiling tile according to any of Embodiments 1 to 24, wherein the panel has a thickness of at least 1/16 inch, e.g., at least 1/8 inch, e.g., at least 1/4 inch, e.g., at least 5/8 inch.

Embodiment 26

The ceiling tile according to any of Embodiments 1 to 25, wherein the panel has a thickness of no more than 3 inches, e.g., no more than 2 inches.

Embodiment 27

The ceiling tile according to any of Embodiments 1 to 26, wherein the light housing spans a breadth of the ceiling tile.

Embodiment 28

The ceiling tile according to any of Embodiments 1 to 27, wherein the light housing includes an elongate wall and first and second end walls.

Embodiment 29

The ceiling tile according to any of Embodiments 1 to 28, wherein the light housing includes an opening through which light is emitted.

Embodiment 30

The ceiling tile according to Embodiment 29, wherein the opening spans a breadth of the ceiling tile.

Embodiment 31

The ceiling tile according to Embodiment 29 or Embodiment 30, wherein the opening is rectangular.

Embodiment 32

The ceiling tile according to any of Embodiments 29 to 31, wherein the opening has a width of at least 1 inch, e.g., at least 2 inches, e.g., at least 3 inches.

Embodiment 33

The ceiling tile according to any of Embodiments 29 to 32, wherein the opening has a width of no more than 12 inches, e.g., no more than 8 inches.

Embodiment 34

The ceiling tile according to any of Embodiments 1 to 33, further comprising a light source that cooperates with the light housing.

Embodiment 35

The ceiling tile according to Embodiment 34, wherein the light source is disposed in the light housing.

Embodiment 36

The ceiling tile according to Embodiment 34 or Embodiment 35, wherein the light source is disposed on an upper side of the panel.

Embodiment 37

The ceiling tile according to any of Embodiments 34 to 36, wherein the light source comprises an array of LEDs.

Embodiment 38

The ceiling tile according to Embodiment 37, wherein the array includes a single column of LEDs.

Embodiment 39

The ceiling tile according to Embodiment 37 or Embodiment 38, further comprising an LED driver disposed on an upper surface of the panel.

Embodiment 40

The ceiling tile according to Embodiment 37 or Embodiment 38, further comprising an LED driver disposed on the light housing.

Embodiment 41

The ceiling tile according to any of Embodiments 34 to 36, wherein the lights source comprises at least one halogen or incandescent bulb.

Embodiment 42

The ceiling tile according to any of Embodiments 34 to 36, wherein the light source comprises a fluorescent bulb.

Embodiment 43

The ceiling tile according to Embodiment 42, further comprising a fluorescent light ballast disposed on an upper surface of the panel.

Embodiment 44

The ceiling tile according to Embodiment 42, further comprising a fluorescent light ballast disposed on the light housing.

Embodiment 45

The ceiling tile according to any of Embodiments 34 to 44, wherein the light housing includes an opening, and wherein the light source is configured to emit light through the opening that is substantially uniform along the length of the opening.

Embodiment 46

The ceiling tile according to any of Embodiments 34 to 45, wherein the light source includes an electrical connector and the electrical connector is disposed on a long side of the light source.

Embodiment 47

The ceiling tile according to any of Embodiments 34 to 46, wherein the light source includes an electrical connector, and wherein the electrical connector is not disposed at an end of the light source.

Embodiment 48

The ceiling tile according to any of Embodiments 1 to 47, further comprising a light reflector disposed in the light housing.

Embodiment 49

The ceiling tile according to Embodiment 48, wherein the light reflector is formed of metal, e.g., steel or aluminum.

Embodiment 50

The ceiling tile according to Embodiment 48, wherein the light reflector is formed of plastic, e.g., acrylic, polycarbonate, ABS or PET.

Embodiment 51

The ceiling tile according to any of Embodiments 48 to 50, wherein the light housing includes an opening, and wherein the light reflector faces the opening.

Embodiment 52

The ceiling tile according to any of Embodiments 48 to 51, wherein the light reflector is curved and concave.

Embodiment 53

The ceiling tile according to any of Embodiments 48 to 51, wherein the light reflector is at an angle to the plane of the ceiling.

Embodiment 54

The ceiling tile according to any of Embodiments 48 to 53, wherein the light housing includes an elongate wall, and wherein the light reflector is formed on a surface of the elongate wall.

Embodiment 55

The ceiling tile according to any of Embodiments 48 to 54, wherein the light reflector is a diffuse reflector.

Embodiment 56

The ceiling tile according to Embodiment 55, wherein the light source is non-diffuse.

Embodiment 57

The ceiling tile according to Embodiment 55 or Embodiment 56, wherein the light reflector includes a diffuse paint.

Embodiment 58

The ceiling tile according to Embodiment 55 or Embodiment 56, wherein the light reflector includes a roughened metal surface.

Embodiment 59

The ceiling tile according to Embodiment 55 or Embodiment 56, wherein the light reflector is formed of a white plastic, e.g., white PET or ABS.

Embodiment 60

The ceiling tile according to any of Embodiments 48 to 54, wherein the light reflector has a mirror-like surface.

Embodiment 61

The ceiling tile according to Embodiment 60, wherein the light source includes a diffuser.

Embodiment 62

The ceiling tile according to any of Embodiments 48 to 61, wherein the light source further comprises a light source that cooperates with the light housing and is not directly visible from a point under the bottom of the ceiling tile, and wherein the light source is configured to shine up onto the light reflector, which directs light to points under the bottom of the ceiling tile.

Embodiment 63

A ceiling system comprising:

a ceiling grid including a plurality of beams defining a plane of the ceiling;

a plurality of first ceiling tiles supported by the ceiling grid; and one or more second ceiling tiles according to any of Embodiments 1 to 62 supported by the ceiling grid.

Embodiment 64

The ceiling system according to Embodiment 63, wherein each first ceiling tile includes a panel that is coplanar with the panel of the second ceiling tile.

Embodiment 65

The ceiling system according to Embodiment 64, wherein the panel of each first ceiling tile includes a planar surface, and wherein the planar surface of each first ceiling tile is coplanar with the planar surface of the second ceiling tile.

Embodiment 66

The ceiling system according to Embodiment 64 or Embodiment 65, wherein the panel of each first ceiling tile extends across an entire breadth of the respective ceiling tile.

Embodiment 67

The ceiling system according to any of Embodiments 63 to 66, wherein each first ceiling tile is rectangular and has a width and a breadth, and wherein the second ceiling tile is rectangular and has a width and a breadth that is the same as the width and the breadth of the first ceiling tiles.

Embodiment 68

The ceiling system according to any of Embodiments 63 to 67, wherein the second ceiling tile is removable from the ceiling grid by lifting the second ceiling tile.

Embodiment 69

The ceiling system according to any of Embodiments 63 to 68, wherein the second ceiling tile includes a contact surface disposed around a perimeter thereof, and wherein the contact surface is supported by the beams of the ceiling grid.

Embodiment 70

The ceiling system according to Embodiment 69, wherein the beams of the ceiling grid include T-beams, and wherein the contact surface of the second ceiling tile rests on flanges of a portion of the beams of the ceiling grid.

Embodiment 71

The ceiling system according to any of Embodiments 63 to 70, wherein the one or more second ceiling tiles includes a group of second ceiling tiles.

Embodiment 72

The ceiling system according to Embodiment 71, wherein each tile in the group of second ceiling tiles is disposed adjacent to at least one other tile in the group of second ceiling tiles.

Embodiment 73

The ceiling system according to Embodiment 72, wherein the tiles in the group of second ceiling tiles are disposed in a line within the ceiling grid.

Embodiment 74

The ceiling system according to Embodiment 73, wherein the tiles in the group of second ceiling tiles have the same orientation, such that the respective light housings form a continuing linear light across the group of second ceiling tiles.

Embodiment 75

The ceiling system according to Embodiment 72, wherein the tiles in the group of second ceiling tiles are oriented to form a continuing path of light across the group of second ceiling tiles.

Embodiment 76

The ceiling system according to Embodiment 72, wherein the tiles in the group of second ceiling tiles are oriented to form a continuous loop of light.

Embodiment 77

A method of installing ceiling tiles in a ceiling, the method comprising:

providing a ceiling grid including a plurality of beams defining a plane and arranged to provide a plurality of openings for ceiling tiles;

placing a plurality of first ceiling tiles in a first portion of the openings; and placing one or more second ceiling tiles in at least one other opening in the ceiling grid so as to form a ceiling system according to any of Embodiments 63 to 76.

Embodiment 78

A method of installing ceiling tiles in a ceiling, the method comprising:

providing a ceiling grid including a plurality of beams defining a plane and arranged to provide a plurality of openings for ceiling tiles;

placing a first ceiling tile in a first opening in the ceiling grid;

placing a second ceiling tile according to any of Embodiments 1 to 62 in a second opening in the ceiling grid.

Embodiment 79

The method according to Embodiment 78, further comprising placing an additional second ceiling tile in a third opening adjacent to the second opening.

Embodiment 80

The method according to Embodiment 79, further comprising positioning the second ceiling tiles to form a continuing linear light using the respective light housings.

Embodiment 81

The method according to Embodiment 78 or Embodiment 79, further comprising placing a group of second ceiling tiles in respective adjacent openings in the ceiling grid.

Embodiment 82

The method according to Embodiment 81, further comprising orienting the group of second ceiling tiles to form a continuing path of light among the second ceiling tiles.

Embodiment 83

The method according to Embodiment 81, further comprising orienting the group of second ceiling tiles to form a continuous loop of light among the second ceiling tiles.

Embodiment 84

The method according to any of Embodiments 78 to 83, wherein the placing the second ceiling tile in the second opening includes lowering the second ceiling tile onto a group of the plurality of beams.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A ceiling system comprising:

a ceiling grid including a plurality of beams defining a plane of the ceiling and defining a plurality of grid openings;

a plurality of first ceiling tiles, each disposed in a respective grid opening and each having edges supported by beams of the ceiling grid, each of the first ceiling tiles having a planar bottom surface; and one or more second ceiling tiles, each disposed in a respective grid opening and each having edges supported by beams of the ceiling grid, wherein each second ceiling tile comprises:

a light housing extending across a first portion of a width of the ceiling tile;

a panel extending across a remaining portion of the width of the ceiling tile, the panel having a planar bottom surface and an upper side, the light housing being attached to the panel and defining an downward-facing opening in an area of the respective grid opening through which light is emitted, the opening having a width no more than 8 inches, the light housing having a light reflector disposed therein and facing downward toward the opening; and a light source disposed on the upper side of the panel, the light source being configured to shine upwardly on the light reflector, the light reflector being configured to reflect light from the light source downwards through the downward-facing opening.

2. The ceiling system according to claim 1, wherein in each of the second ceiling tiles the light housing is a linear light housing.

3. The ceiling system according to claim 1, wherein in each of the second ceiling tiles the light housing extends from a first edge of the ceiling tile.

4. The ceiling system according to claim 1, wherein in each of the second ceiling tiles the light housing is nonlinear.

5. The ceiling system according to claim 1, wherein each of the second ceiling tiles further comprises a contact surface disposed around a perimeter of the ceiling tile, the contact surface defining the plane of the ceiling.

6. The ceiling system according to claim 5, wherein in each of the second ceiling tiles the contact surface includes an outer edge of the light housing.

7. The ceiling system according to claim 1, wherein in each of the second ceiling tiles the first portion is at least 5 percent and no more than 30 percent of the width of the ceiling tile, and wherein the panel forms at least 70 percent and no more than 95 percent of the width of the ceiling tile.

8. The ceiling system according to claim 1, wherein in each of the second ceiling tiles the light housing spans a breadth of the ceiling tile.

9. The ceiling system according to claim 1, wherein in each of the second ceiling tiles the light housing includes an opening through which light is emitted, wherein the opening spans a breadth of the second ceiling tile.

10. The ceiling system according to claim 1, wherein in each of the second ceiling tiles the light source is disposed on a surface of the light housing that is disposed against an upper side of the panel.

11. The ceiling system according to claim 1, wherein in each of the second ceiling tiles the light source and the reflector are configured to emit light through the downward-facing opening that is substantially uniform along the length of the opening.

12. The ceiling system according to claim 1, wherein in each of the second ceiling tiles the light reflector is a diffuse reflector.

13. The ceiling system according to claim 1, wherein in each of the second ceiling tiles the light source is not directly visible from a point under the bottom of the ceiling tile.

14. The ceiling system according to claim 1, wherein the ceiling system includes a plurality of the second ceiling tiles, the second ceiling tiles being oriented to form a continuing path of light across the plurality of second ceiling tiles.

15. The ceiling system according to claim 1, wherein each of the first ceiling tiles is a flat ceiling tile.

16. The ceiling system according to claim 1, wherein the planar bottom surfaces of the first ceiling tiles are coplanar with the planar bottom surfaces of the panels of the second ceiling tiles.

17. The ceiling system according to claim 1, wherein in each of the second ceiling tiles the light source is an array of LEDs.

18. The ceiling system according to claim 1, wherein in each of the second ceiling tiles the opening has a width of at least 1 inch.

19. The ceiling system according to claim 1, wherein in each of the second ceiling tiles the panel includes a body composed of at least one of fiberglass, paper, stone wool, slag wool, perlite, and gypsum board.

20. The ceiling system according to claim 1, wherein in each of the second ceiling tiles a plurality of edges of the panel form edges of the second ceiling tile supported by beams of the ceiling grid.

* * * * *